US012690654B2

(12) United States Patent
Fletcher

(10) Patent No.: US 12,690,654 B2
(45) Date of Patent: Jul. 28, 2026

(54) FLAT IRON COMB

(71) Applicant: Catina R. Fletcher, Valdosta, GA (US)

(72) Inventor: Catina R. Fletcher, Valdosta, GA (US)

( * ) Notice: Subject to any disclaimer, the term of this patent is extended or adjusted under 35 U.S.C. 154(b) by 380 days.

(21) Appl. No.: 17/960,193

(22) Filed: Oct. 5, 2022

(65) Prior Publication Data

US 2023/0114339 A1 Apr. 13, 2023

Related U.S. Application Data

(60) Provisional application No. 63/253,604, filed on Oct. 8, 2021.

(51) Int. Cl.

| | |
|---|---|
| ***A45D 1/04*** | (2006.01) |
| ***A45D 1/06*** | (2006.01) |
| ***A45D 1/18*** | (2006.01) |
| ***A45D 1/28*** | (2006.01) |

(52) U.S. Cl.

CPC ..... *A45D 1/18* (2013.01); *A45D 1/04* (2013.01); *A45D 1/06* (2013.01); *A45D 1/28* (2013.01)

(58) Field of Classification Search

CPC ... A45D 1/28; A45D 1/18; A45D 1/06; A45D 1/04; A45D 1/16; A45D 2001/002; A45D 20/48; A45D 2/40

USPC ..... 132/269, 271, 118, 145, 148, 224–225

See application file for complete search history.

(56) References Cited

U.S. PATENT DOCUMENTS

| | | | | | |
|---|---|---|---|---|---|
| 1,421,313 | A * | 6/1922 | Scharer | A45D 1/18 | 132/118 |
| 3,279,055 | A * | 10/1966 | Penn | B26B 21/02 | 132/148 |
| 3,877,472 | A * | 4/1975 | D'Angelo | A45D 24/36 | 132/145 |
| 4,126,143 | A * | 11/1978 | Schroeder | A45D 20/48 | 132/118 |
| 4,766,291 | A * | 8/1988 | Collins | A45D 20/48 | 219/544 |
| 4,819,674 | A * | 4/1989 | Takimae | A45D 1/04 | 132/224 |
| 6,138,376 | A | 10/2000 | Garfinkel | | |
| RE38,713 | E | 3/2005 | Habibi | | |
| D833,750 | S | 11/2018 | Richmond et al. | | |
| 2006/0130865 | A1* | 6/2006 | Blyden | A45D 24/10 | 132/118 |
| 2006/0137705 | A1* | 6/2006 | Barrett | A45D 1/18 | 132/224 |
| 2007/0107746 | A1* | 5/2007 | Randolph | B26B 13/24 | 132/118 |

(Continued)

*Primary Examiner* — Nicholas D Lucchesi
*Assistant Examiner* — Jennifer Gill
(74) *Attorney, Agent, or Firm* — Thompson Hine LLP

(57) ABSTRACT

A device (e.g., a flat iron comb) for hair styling. The device includes a comb part and a flat iron part. The comb part includes an upper portion including a plurality of heating elements and a handle including a first end and a second end, wherein the first end is coupled to the upper portion. The flat iron part includes an upper portion that includes an inside surface with a heating plate, wherein the inside surface of the flat iron part faces an inside surface of the comb part, and a handle including a first end and a second end, wherein the first end is coupled to the upper portion. The device further includes a power cord and a pivot link. The second end of the handle of the flat iron part and the second end of the handle of the comb part are coupled at the pivot link.

16 Claims, 6 Drawing Sheets

(56) References Cited

U.S. PATENT DOCUMENTS

| | | | | |
|---|---|---|---|---|
| 2009/0126751 | A1* | 5/2009 | Barrett | A45D 1/04 132/229 |
| 2010/0300477 | A1* | 12/2010 | Keong | A45D 1/04 132/269 |
| 2013/0146081 | A1* | 6/2013 | Chan | A45D 2/001 132/229 |
| 2013/0247933 | A1* | 9/2013 | Oh | A45D 2/002 132/269 |
| 2013/0247934 | A1* | 9/2013 | Han | A45D 2/002 132/269 |
| 2015/0007842 | A1* | 1/2015 | Howze | A45D 24/10 132/118 |
| 2016/0135564 | A1* | 5/2016 | Bang | A45D 2/002 132/269 |
| 2017/0290402 | A1* | 10/2017 | Aizenberg | A45D 1/28 |
| 2018/0177272 | A1* | 6/2018 | Nakasone | A45D 1/06 |
| 2018/0255897 | A1* | 9/2018 | Kelley | A45D 2/002 |
| 2019/0387856 | A1* | 12/2019 | Nowak | A45D 6/00 |
| 2020/0008553 | A1* | 1/2020 | Shami | A45D 20/24 |

* cited by examiner

FLAT IRON COMB

CROSS-REFERENCE TO RELATED APPLICATIONS

This application claims the benefit of U.S. Provisional Application Ser. No. 63/253,604 filed Oct. 8, 2021, which is incorporated herein in its entirety.

TECHNICAL FIELD

The present invention relates generally to a hair styler. More specifically, the present invention relates to a hair styler which enables a user to straighten his or her hair.

BACKGROUND

Many devices have been devised to aid in styling hair. Hair curlers, for example, are used to impart curls into hair. They may be used on dry hair but work best on wet hair. Steam may be applied to assist in setting the hair to the curl of the curlers. Curling irons typically incorporate an electrical heating element to heat one or both sides of a smooth but curved pair of mating surface between which hair is placed to be curled. The hair may preferably be pulled through the interface of the mating surfaces of the curling iron to aid in curling the hair. On the other hand, hair straighteners operate much like curling irons, but they have smooth mating flat surfaces which act to straighten the hair when compressed against and pulled along the hair.

Several prior hair styler devices, such as irons and straighteners, include a pair of untextured surfaces for engaging the hair. As a result, the hair can become tangled, or require much additional combing or brushing with another apparatus such as a comb or brush in order to achieve the desired style. Or two devices (e.g., an iron and a comb) are used to combat this issue. However, this additional combing and/or brushing can undesirably disrupt the style imparted by the irons and straighteners. Accordingly, it would be desirable to provide a hair styling device capable of use in curling, straightening and/or waving hair.

SUMMARY

Embodiments of the present invention provide a haircare appliance as a combination of a hot comb and a hair flat iron device for providing both combing & flat ironing of hair and protection from burning or the scalp. The flat iron comb device provides both combing & flat ironing of hair and protection from burning of the scalp. For example, to cut down time in half when a stylist flat irons a customer hair, the flat iron comb provided herein is a lightweight and ergonomic such that it would be comfortable and controllable in one hand. Additionally, the flat iron comb includes a the 360-swivel cord for increased flexibility. The flat iron comb provides a multifunctional professionally designed, hot comb, hair straightener, frizzy hair eliminator, split end & knotting hair remover, all in one product.

In some embodiments of the invention, a device for hair styling. The device includes a comb part including an upper portion comprising a plurality of heating elements, and a handle comprising a first end and a second end, where the first end is coupled to the upper portion, a flat iron part including an upper portion that includes an inside surface with a heating plate, wherein the inside surface of the flat iron part faces an inside surface of the comb part, a handle comprising a first end and a second end, wherein the first end is coupled to the upper portion, a power cord, and a pivot link, wherein the second end of the handle of the flat iron part and the second end of the handle of the comb part are coupled at the pivot link to permit the device to achieve both an open position and a closed position.

These and other embodiments can each optionally include one or more of the following features.

In some embodiments, the device, in the open position, is configured to allow placement of hair of a user between the inside surface of the flat iron part and the inside surface of the comb part.

In some embodiments, the device is further configured to allow a user to heat the hair of the user between the inside surface of the flat iron part and the inside surface of the comb part in the closed position by applying heat to the heating plate and the plurality of heating elements.

In some embodiments, the handle of the flat iron part comprises a heat setting control panel.

In some embodiments, the heat setting control panel comprises heat setting controls and a heat display.

In some embodiments, each heating element comprises double-side ceramic material configured to evenly transfer heat. In some embodiments, each heating element comprises a thermal insulation tip at a distal end of the heating element.

In some embodiments, the power cord connects to the comb part and the flat iron part at the pivot link. In some embodiments, the power cord comprises a rotating member.

In some embodiments, the pivot link comprises a hinge mechanism. In some embodiments, the pivot link is configured to allow a user to move the device to an open position and a closed position.

In some embodiments, each handle comprises a hand grip.

In some embodiments, when the device is in a closed position, a first edge of the upper portion of the comb part that includes the plurality of heating elements align with a first edge of the upper portion of the flat iron part.

In some embodiments, when the device is in a closed position, a second edge of the upper portion of the comb part aligns with a second edge of the upper portion of the flat iron part.

In some embodiments, when the device is in a closed position, a first edge of the handle of the comb part align with a first edge of the handle of the flat iron part.

In some embodiments, when the device is in a closed position, a second edge of the handle of the comb part aligns with a second edge of the handle of the flat iron part.

In some embodiments, each of the plurality of heating elements of the comb part forms an elongated comb tooth, and an elongated axis of each comb tooth runs substantially parallel to the inside surface of the flat iron part when the device is in the closed position.

In some embodiments, a hair straightening method for styling hair strands from a scalp to an end of the hair strands includes the steps of using a device for hair styling, the device including a comb part that includes an upper portion comprising a plurality of heating elements and a lower portion that includes a handle, and a flat iron part that includes an upper portion that includes an inside surface with a heating plate and a lower portion that includes a handle, where the handle of the comb part is coupled to the handle of the flat iron part via a pivot link, opening the comb part and the flat iron part via the pivot link, and receiving a plurality of hair strands therebetween, the comb part being close to the scalp, closing the comb part and the flat iron part via the pivot link until the comb part and the flat iron are in close proximity and the plurality of hair strands are secured therebetween, applying heat to the plurality of hair strands from the heating plate and the plurality of heating elements, and pulling the comb part and the flat iron part by the handles down the hair strand to import a dry and straight condition to the plurality of hair strands.

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

BRIEF DESCRIPTION OF THE DRAWINGS

The accompanying drawings, which are incorporated in and constitute a part of this specification, illustrate various embodiments of the present invention and, together with the general description of the invention given above, and the detailed description of the embodiments given below, serve to explain the embodiments of the invention. In the drawings, like reference numerals are used to indicate like parts in the various views.

DETAILED DESCRIPTION

Figure 1:
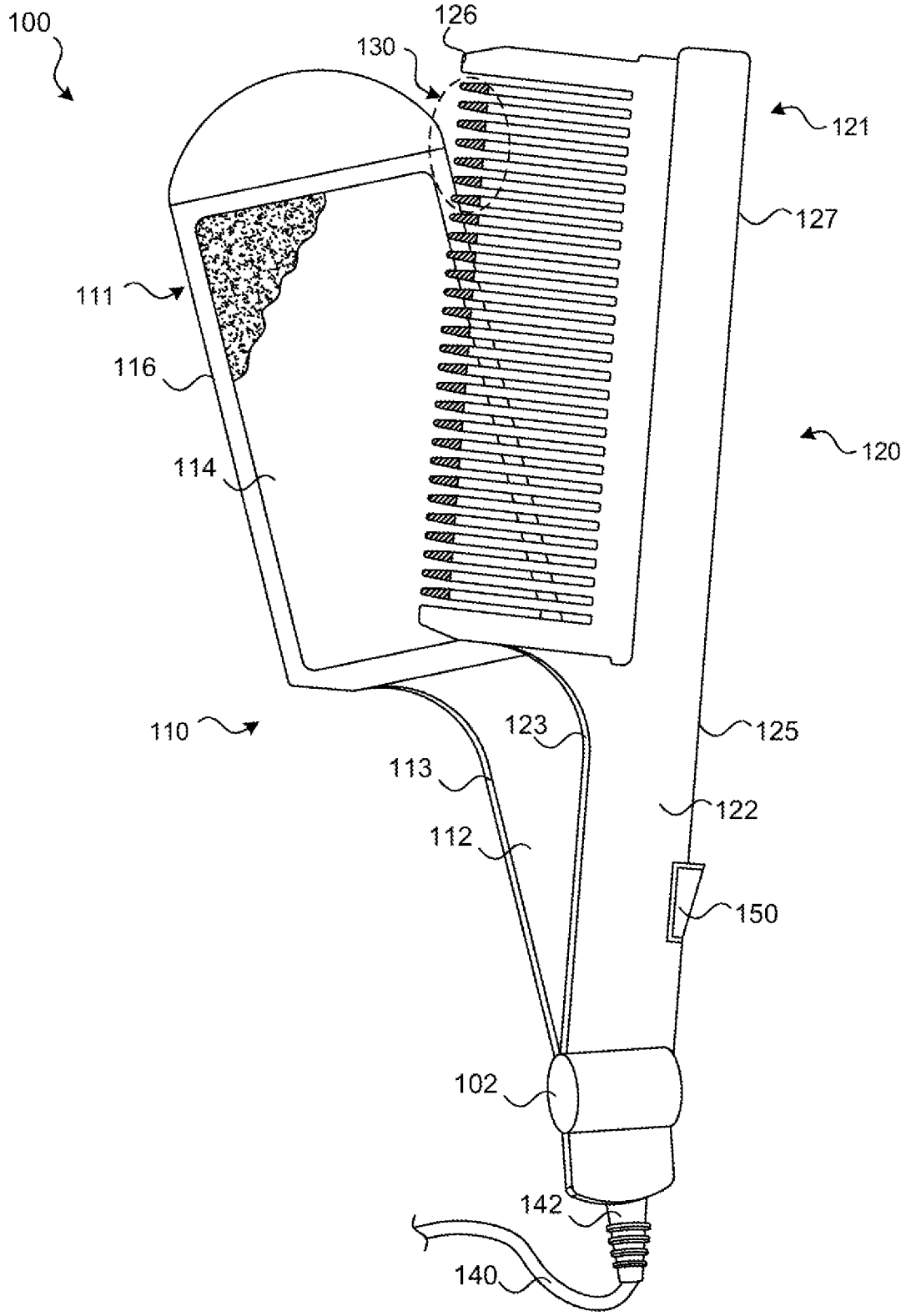
FIG. 1 illustrates a view of a flat iron comb device in an open position in accordance with aspects of the present invention.

Techniques described herein relate to a haircare apparatus that is a combination of a hot comb and a hair flat iron device for providing both combing & flat ironing of hair and protection from burning of the scalp. The flat iron comb device provides both combing & flat ironing of hair and protection from burning of the scalp. For example, to cut down time in half when a stylist flat irons a customer hair, the flat iron comb provided herein is a lightweight and ergonomic such that it would be comfortable and controllable in one hand. Additionally, the flat iron comb may include a the 360-swivel cord for increased flexibility. The flat iron comb provides a multifunctional professionally designed, hot comb, hair straightener, frizzy hair eliminator, split end & knotting hair remover, all in one product.

This document describes a flat iron comb device for styling hair. This document further describes a hair straightening method for styling hair strands from a scalp to an end of the hair strands.

Many aspects of the subject matter described herein can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 illustrates a perspective view of a flat iron comb device 100 for styling hair, with the device in an open position. The flat iron comb device 100 includes a flat iron part 110 and a comb part 120.

The flat iron part 110 includes a flat heating plate 114 at an upper portion 111 and a handle 112. The upper portion 111 of the flat iron part 110 includes a first edge 116 and a second edge 118 (not shown in FIG. 1). The handle 112 of the flat iron part 110 includes a first edge 113 and a second edge 115 (not shown in FIG. 1). The flat iron part 110 will be discussed in further detail with reference to FIG. 3.

The comb part 120 has an elongated axis 120*a* and includes double-sided ceramic plates (e.g., a plurality of heating elements 134, also referred to herein as "heated teeth") at an upper portion 121, a handle 122, and an on/off switch 150. The upper portion 121 of the comb part 120 includes a first edge 126 and a second edge 127. The handle 122 of the comb part 120 includes a first edge 123 and a second edge 125. The comb part 120 will be discussed in further detail with reference to FIG. 4.

The flat iron comb device 100 further includes a pivot link 102 that is configured as a hinge mechanism and operably couples the flat iron part 110 and the comb part 120 together and allows a user to open and close the flat iron comb device 100. Alternatively, although the pivot link 102 is illustrated as a hinge mechanism, the pivot link 102 may include other mechanical means that provides a pivoting point such that the flat iron part 110 and the comb part 120 are coupled together and allows a user to open and close the flat iron comb device 100. The types of hinge mechanisms that may be used (but not limited to) may include: a ball bearing hinge, a spring-loaded butt hinge, a barrel hinge, an overlay hinge, an offset hinge, a strap hinge, and the like.

The flat iron comb device 100 further includes a power cord 140 that is connected to the bottom of the flat iron comb device 100 and includes a rotating member 142 (e.g., a 360-degree swivel attachment). The flat iron comb device 100 may be powered by a standard AC power source (e.g., 120 volts at 60 Hz frequency) via the power cord 140.

In some implementations, in operation, the device 100, in an open position (as illustrated in FIG. 1), is configured to allow placement of hair of a user between the inside surface of the flat iron part 110 (e.g., the illustrated surface of the flat heating plate 114 as shown in FIG. 1) and the inside surface of the comb part (e.g., the surface of the comb part 120 that is facing the flat heating plate 114 that is not shown in FIG. 1). Additionally, in some implementations, the device 100 is further configured to allow a user to heat the hair of the user between the inside surface of the flat iron part 110 and the inside surface of the comb part 120 in a closed position by applying heat to the heating plate 114 and applying heat to the plurality of heating elements 134. The operation of device 100 is further illustrated in FIG. 6.

Alternatively, in some implementations, heat may be applied to the heating plate 114 and to the plurality of heating elements 134 separately (e.g., one side on, one side off). In some implementations, heat may be controlled as it is applied to the heating plate 114 and to the plurality of heating elements at the edge 126 of the comb part 120 based on detected conditions of the hair by a sensor on the device 100 or an external sensor (e.g., based on hair humidity), and/or by user control settings. For example, a variable heat setting may allow heat to fluctuate in the heating elements in the comb part 120, but apply constant heat to the heating plate 114 (e.g., low, medium, high, etc.), or vice versa.

Figure 2:
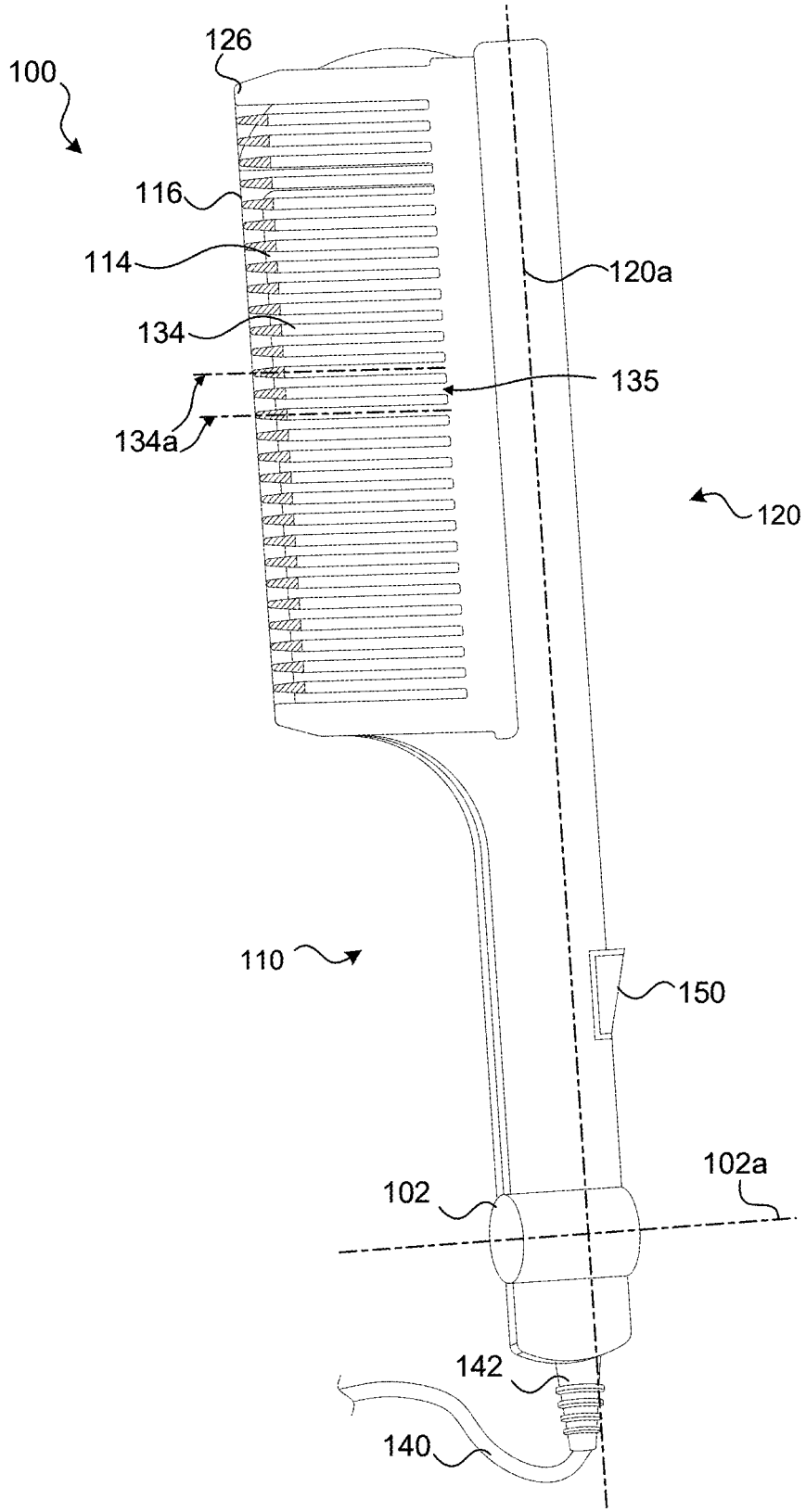
FIG. 2 illustrates a view of a flat iron comb device in a closed position.

FIG. 2 illustrates a view of the flat iron comb device 100 in a closed position. As shown, the first edge 126 of the comb part 120 (e.g., the end tips of the plurality of heating elements) and the first edge 116 of the flat iron part 110 are in alignment when in the closed position. Alternatively, in some implementations, the first edge 126 of the comb part 120 may be longer than the first edge 116 of the flat iron part 110 such that the thermal insulation points (ends) of the plurality of heating elements of the comb part 120 extend past the first edge 116 of the flat iron part 110. Notably, the elongated axis (e.g., 134*a*) of each tooth-style heating element 134 extends transverse to the elongated axis 120*a* and runs substantially parallel to the surface defined by the flat heating plate of the flat part 110 when the device is in the closed position. FIG. 2 illustrates the pivot link 102 defining a pivot axis 102*a*. Per FIG. 2, when the device is in the closed position, portions of some of the teeth-style heating elements 134 overly regions of the heating plate 114 of the flat iron part, and portions of some gaps 135 between the teeth-style heating elements 134 overly regions of the heating plate 114 of the flat iron part 110. Further, when the device is in the closed position, the direction of overlap between the heating elements 134 and the heating plate 114 runs parallel to the pivot axis 102*a*.

Figure 3:
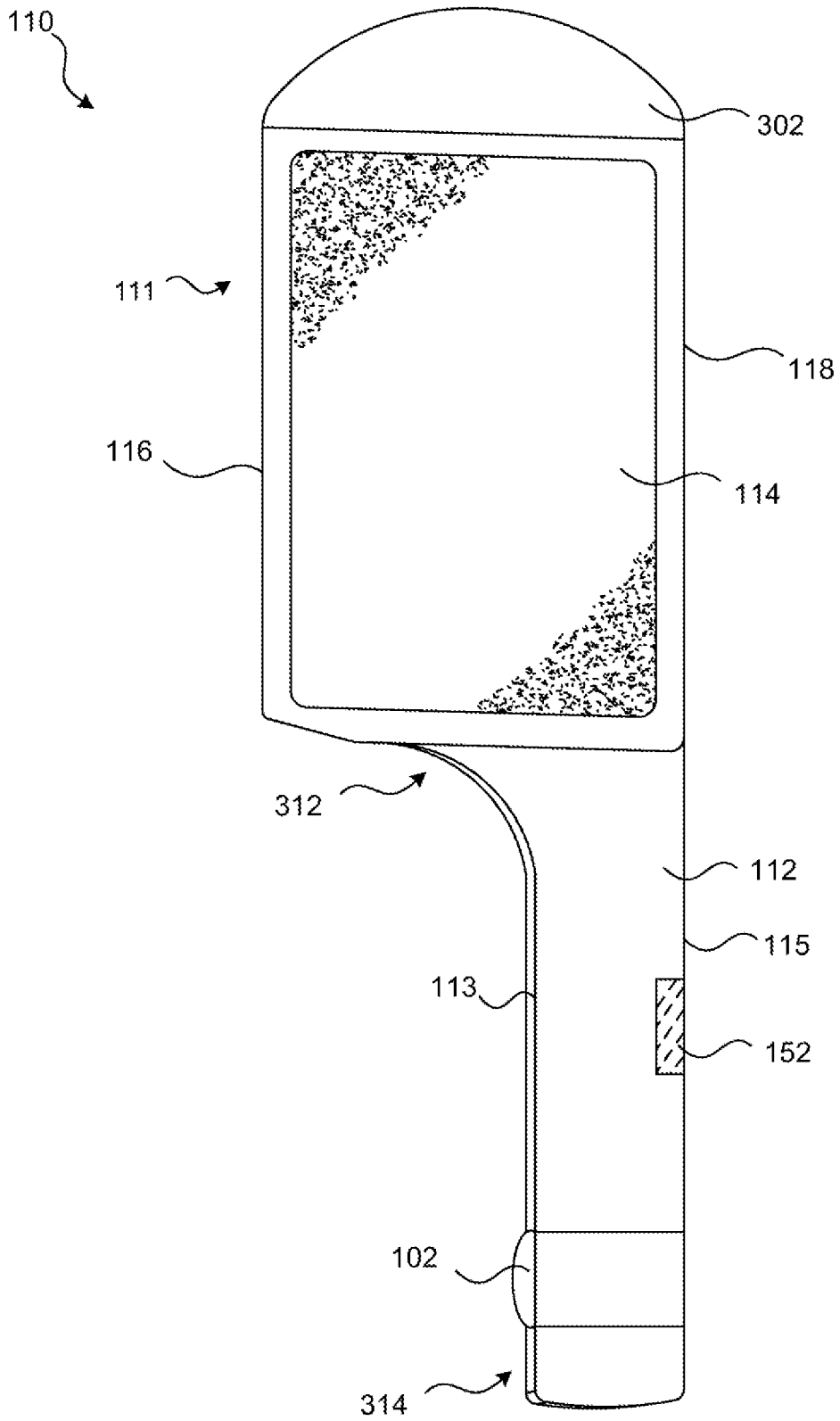
FIG. 3 illustrates a cross-sectional view, showing a flat iron part of the flat iron comb device.

FIG. 3 illustrates a cross-sectional view of the device showing only the flat iron part 110 of the flat iron comb device 100. The flat iron part 110 includes a flat heating plate 114 at the upper portion 111 and a handle 112. The upper portion 111 of the flat iron part 110 includes a first edge 116, a second edge 118, and a top portion 302. The handle 112 of the flat iron part 110 includes a first edge 113, a second edge 115, and a bottom portion 314 (e.g., below the pivot link 102). The handle 112 and the upper portion 111 of the iron part 110 are coupled at the middle portion 312. As shown, the heating plate 114 further includes a heat setting control panel 152. The heat setting control panel 152 may include heat setting controls and a heat display as further illustrated in FIG. 5.

In some implementations, the heating plate 114 is a ceramic plate that is configured to externally conduct heat based on receiving electric current by a standard AC power source (e.g., 120 volts at 60 Hz frequency) via the power cord 140. Alternatively, a different material may be used for the heating plate 114 that properly conducts heat (e.g., aluminum, ceramic composite materials, enamel, and the like). For example, a thick film heater may be used for the heating plate 114 that may include a variety of substrates including metal, ceramic, glass, polymer using metal/alloy-loaded thick film pastes, etc. In some implementations, the heating plate 114 is embedded within the upper portion 111 such that the surface of the upper portion 111 and the heating plate 114 provide together a flat surface (further shown in a perspective view of FIG. 5).

Figure 4:
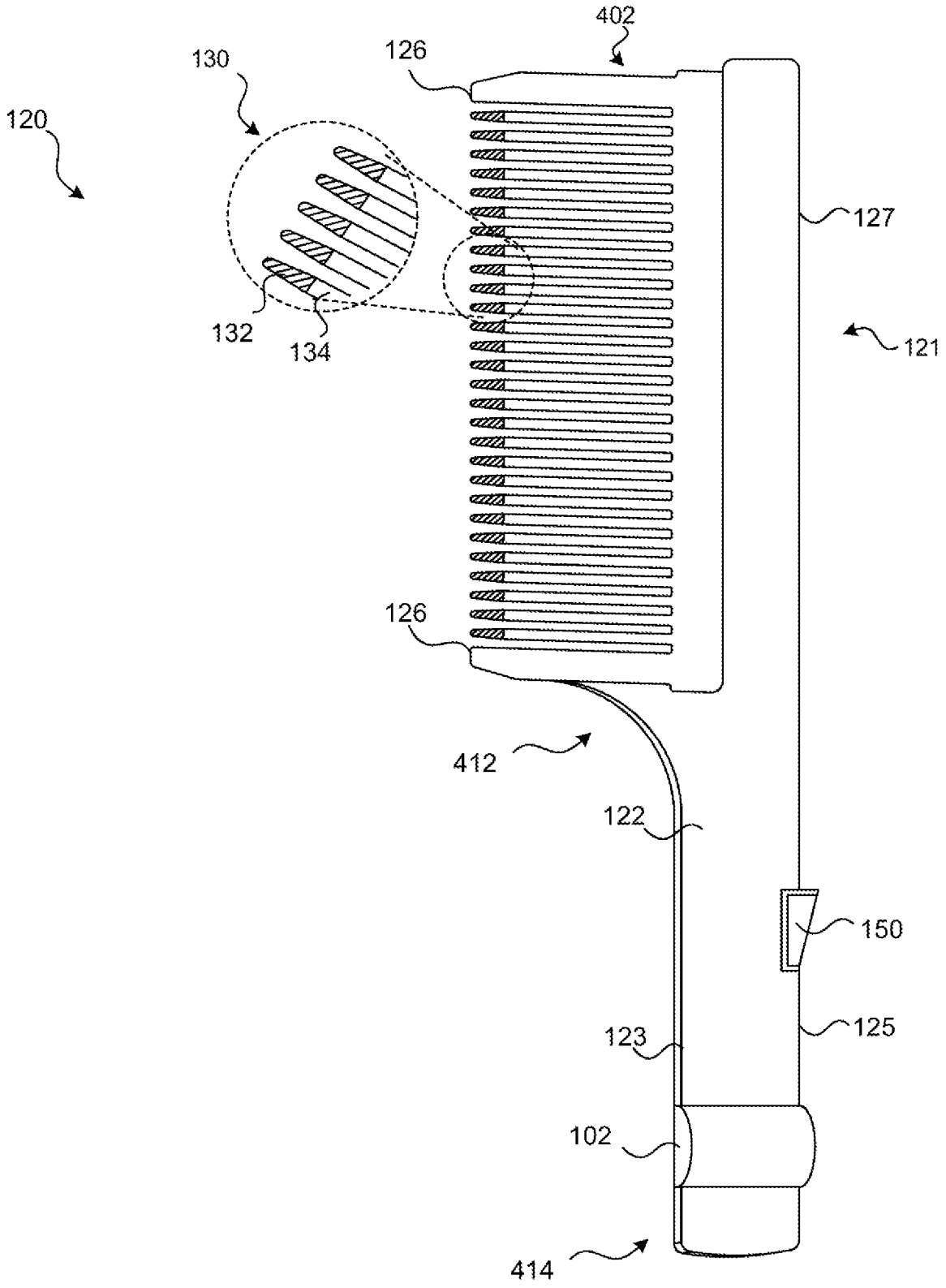
FIG. 4 illustrates a cross-sectional view, showing a comb part of the flat iron comb device.

FIG. 4 illustrates a cross-sectional view of the device showing only the comb part 120 of the flat iron comb device 110. The comb part 120 includes a plurality of heating elements 134 (also referred to herein as "heated teeth") at area 130 at the upper portion 121 and a handle 122. The upper portion 121 of the comb part 120 includes a first edge 126, a second edge 127, and a top portion 402. The handle 122 of the comb part 120 includes a first edge 123, a second edge 125, an on/off switch 150, and a bottom portion 414 (e.g., below the pivot link 102). The handle 122 and the upper portion 121 of the comb part 120 are coupled at the middle portion 412.

As shown at the expanded view of area 130, each heating element 134 of the plurality of heating elements 134 include a thermal insulation tip 132 at a distal end of the heating element (e.g., distal end referring to the end at the first edge 126 of the upper portion 121 of the comb part 120). The plurality of heating elements 134 may include double-sided ceramic material configured to evenly transfer heat (e.g., as hair is provided between the plurality of heating elements 134). The thermal insulation tip(s) 132 may include additional material (e.g., cellulose, fiberglass, polyurethane foam, and the like) that provide anti-scald thermal insulation protection. For example, protective comb like ends made of thermal insulation to prevent a user from burning the scalp.

Figure 5:
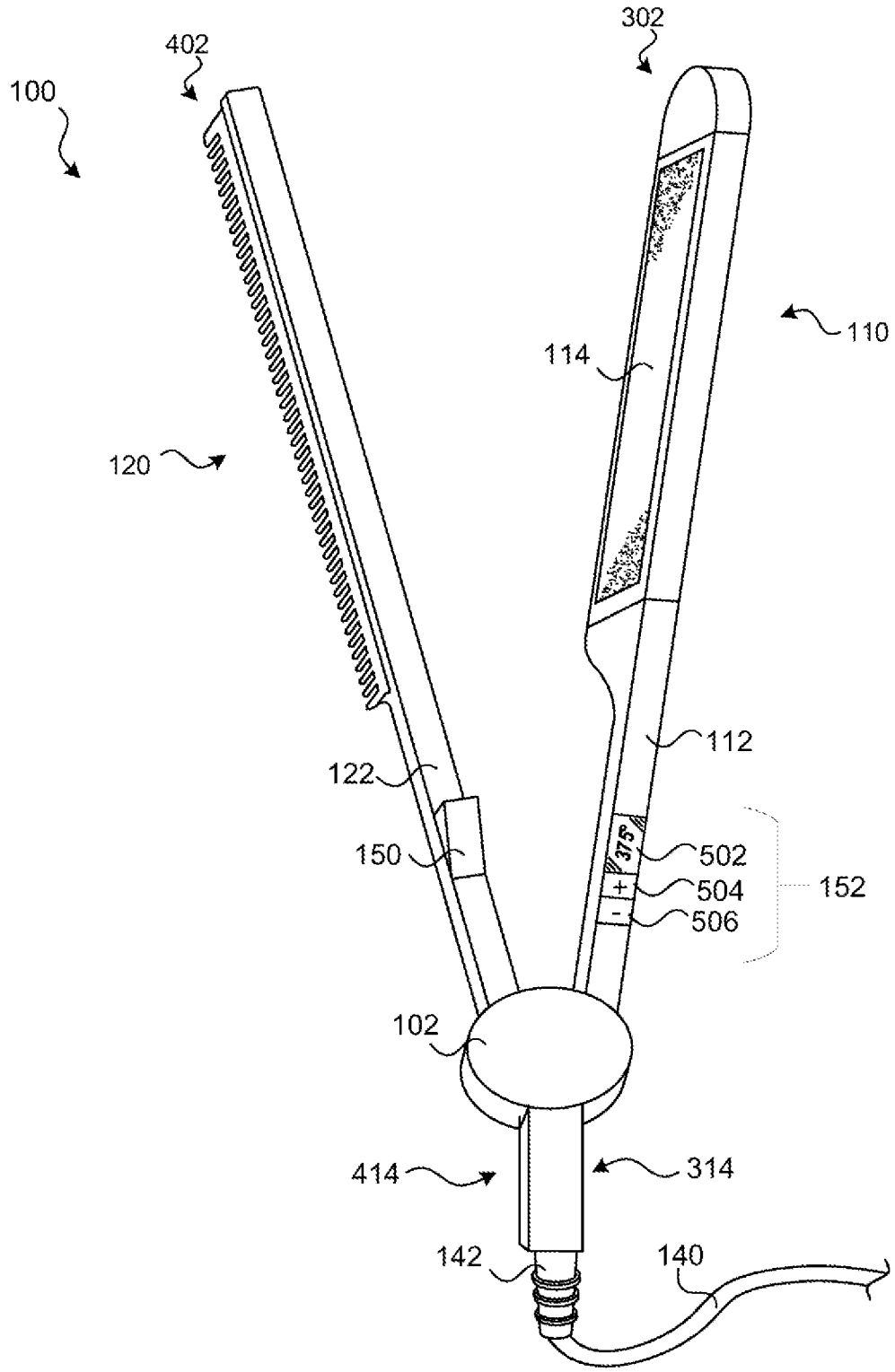
FIG. 5 illustrates a perspective view of a flat iron comb device in an open position.

FIG. 5 illustrates a perspective view of a flat iron comb device 100 in an open position. In particular, FIG. 5 provides a user's perspective (e.g., a stylist's view) of the flat iron comb device 100. As shown, the heating plate 114 is shown as embedded within the surface of the flat iron part 110, such that a linear (e.g., smooth) uniform surface is present. Additionally, other features are illustrated in FIG. 5 that provides a user's perspective (e.g., a stylist's view) of the flat iron comb device 100. For example, the on/off switch 150 and the heat setting control panel 152 are within direct view such that a user can appreciate holding the device 100 with a single hand and be able to control the on/off switch 150 and the features associated with the heat setting control panel 152.

As shown, the heat setting control panel 152 includes features such as a display 502 (e.g., to show a current setting, a temperature, etc.), an increase temperature button 504, and a decrease temperature button 506. For example, these settings may apply heating both the heating plate 114 of the flat iron part 110 and the plurality of heating elements 134 of the comb part 120. Additionally, or alternatively, in some implementations, other features and buttons may be included in the heat setting control panel 152 to control the device 100.

In some implementations, other than the heating plate 114 and the plurality of heating elements 132 (e.g., the "heated teeth") that require thermal insulated materials, as discussed herein, the remaining materials of the device 100 may be made of suitable high strength materials to withstand forces and stresses imparted from various angles and positions during operation of the device 100. The selected material may further be lightweight so that the device 100 may still be easily handled by one hand/arm of a user and transportable. In some embodiments, exterior portions of the device 100 may be made of carbon fiber materials.

Figure 6:
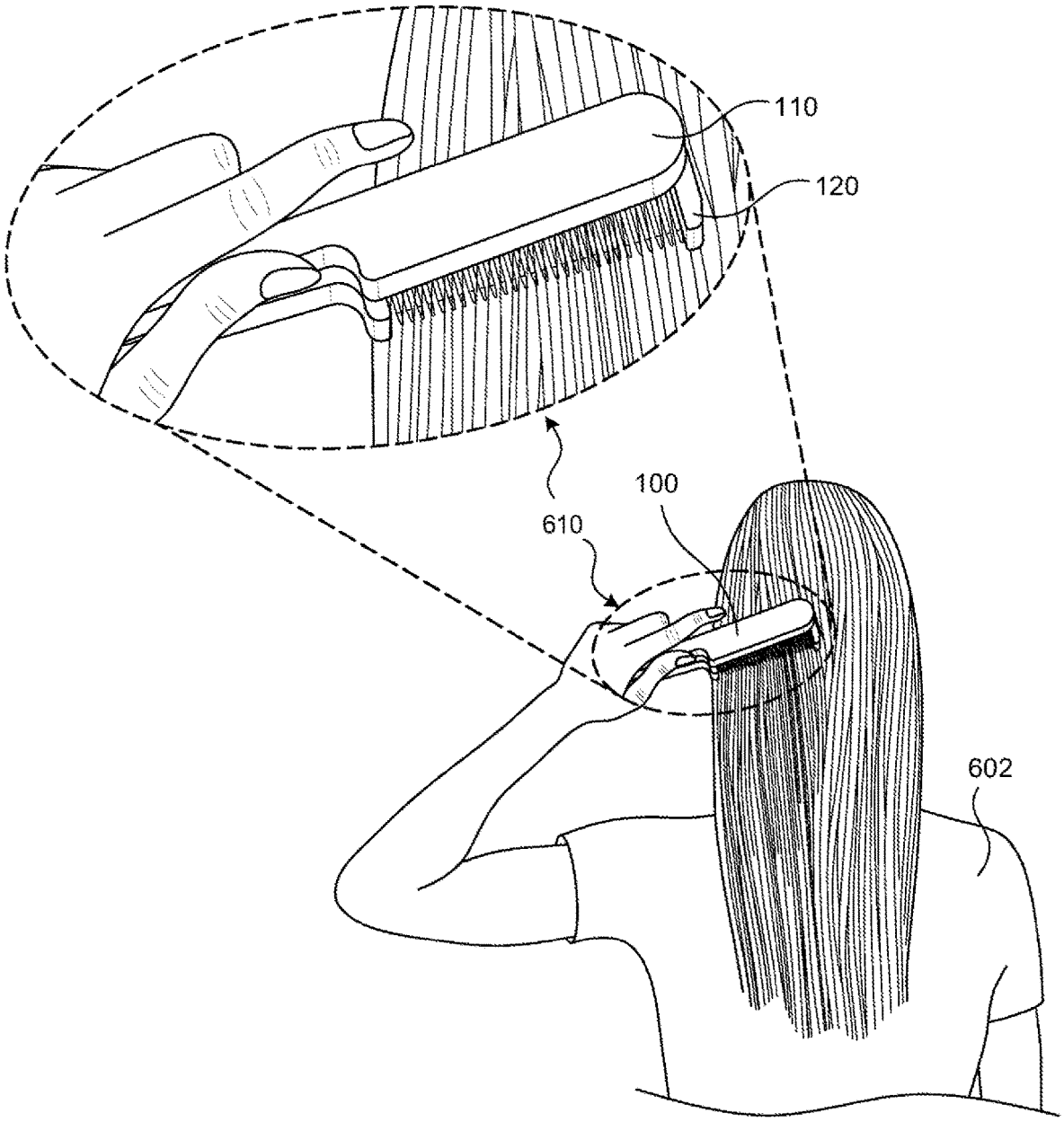
FIG. 6 illustrates the flat iron comb device in exemplary operation.

FIG. 6 illustrates the flat iron comb device 100 in exemplary operation. As shown, the user 602 is using the flat iron comb device 100 to straighten their hair. Alternatively, another user (e.g., a stylist) may use the flat iron comb device 100 on the user 602 (e.g., a client's hair). As shown in the expanded area 610, the flat iron comb device 100 is used with the comb part 120 being closest to the hair of the user 602, with the heating elements (e.g., "heated teeth") facing downwards as the user 602 brushes their hair in a downward motion. To start the process of straightening their hair, the user places the flat iron comb device 100 in an open position, turns on the heating elements via the on/off switch 150, places a section of hair between the comb part 120 and the flat iron part 110, places the flat iron comb device 100 in a closed position, and brushes their hair downward to heat and straighten their hair in slow and controlled manner.

In some implementations, the device 100 may be used for a hair straightening method for styling hair strands from a scalp to an end of the hair strands as illustrated in the FIG. 6. The method for styling hair strands may include a series of steps. A first step may include providing a device for hair styling (e.g., device 100), the device including a comb part (e.g., comb part 120) that includes an upper portion including a plurality of heating elements and a lower portion that includes a handle, and a flat iron part (e.g., flat iron part 110) that includes an upper portion that includes an inside surface with a heating plate and a lower portion that includes a handle, where the handle of the comb part is coupled to the handle of the flat iron part via a pivot link. The steps may further include opening the comb part and the flat iron part via the pivot link, and receiving a plurality of hair strands therebetween, the comb part being close to the scalp. The steps may further include closing the comb part and the flat iron part via the pivot link until the comb part and the flat iron are in close proximity and the plurality of hair strands are secured therebetween. The steps may further include applying heat to the plurality of hair strands from the heating plate and the plurality of heating elements. The steps may further include slowly pulling the comb part and the flat iron part by the handles down the hair strand to apply a dry and straight condition to the plurality of hair strands.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising."

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed:

1. A device for hair styling, the device comprising:

a comb part with an elongated axis comprising:

an upper portion comprising a plurality of heating elements, wherein each heating element of the plurality of heating elements forms an elongated comb tooth having a longitudinal axis that extends transverse to the elongated axis in a direction that runs from a first lateral edge of the comb part toward a second lateral edge of the comb part and includes a distal end comprised by a thermal insulation tip, wherein the plurality of heating elements are of substantially uniform length; and a handle comprising a first end and a second end, wherein the first end is coupled to the upper portion of the comb part;

a flat iron part comprising:

an upper portion that includes an inside surface with a heating plate, wherein the inside surface of the flat iron part faces an inside surface of the comb part; and a handle comprising a first end and a second end, wherein the first end is coupled to the upper portion of the flat iron part;

a pivot link defining a pivot axis, wherein the second end of the handle of the flat iron part and the second end of the handle of the comb part are coupled at the pivot link to permit the device to achieve both an open position and a closed position; and a power cord coupled adjacent the pivot link and including a rotating member configured to permit rotation of the power cord relative to the device;

wherein, when the device is in the closed position:

(i) at least a portion of each of the plurality of heating elements of the comb part include portions that overlie regions of the heating plate that extend parallel to the direction, wherein the direction runs parallel to the pivot axis, (ii) gaps between adjacent heating elements of the plurality of heating elements overlie regions of the heating plate, and (iii) end portions of the plurality of heating elements extend beyond the heating plate, wherein at least one of the comb part and the flat iron part further comprises a heat setting control panel including heat setting controls and a heat display, and each heating element comprises a double-sided ceramic material configured to evenly transfer heat.

2. A hair straightening method for styling hair strands from a scalp to an end of the hair strands comprising the steps of:

using a device for hair styling, the device comprising:

a comb part with an elongated axis, wherein the comb part includes an upper portion comprising a plurality of heating elements and a lower portion that includes a handle, wherein each heating element of the plurality of heating elements forms an elongated comb tooth having a longitudinal axis that extends transverse to the elongated axis in a direction that runs from a first lateral edge of the comb part toward a second lateral edge of the comb part and includes a distal end comprised by a thermal insulation tip, wherein the plurality of heating elements are of substantially uniform length, and a flat iron part that includes an upper portion that includes an inside surface with a heating plate and a lower portion that includes a handle, a power cord coupled adjacent the pivot link and including a rotating member configured to permit rotation of the power cord relative to the device, wherein the handle of the comb part is coupled to the handle of the flat iron part via a pivot link defining a pivot axis, wherein, when the device is in the closed position:

(i) at least a portion of each of the plurality of heating elements of the comb part include portions that overlie regions of the heating plate that extend parallel to the direction, wherein the direction runs parallel to the pivot axis, (ii) gaps between adjacent heating elements of the plurality of heating elements overlie regions of the heating plate, and (iii) end portions of the plurality of heating elements extend beyond the heating plate;

opening the comb part and the flat iron part via the pivot link, and receiving a plurality of hair strands therebetween, the comb part being close to the scalp;

closing the comb part and the flat iron part via the pivot link until the comb part and the flat iron are in close proximity and the plurality of hair strands are secured therebetween;

applying heat to the plurality of hair strands from the heating plate and the plurality of heating elements; and pulling the comb part and the flat iron part by the handles down the hair strand to apply a dry and straight condition to the plurality of hair strands.

3. The device of claim 1, wherein the device, in the open position, is configured to allow placement of hair of a user between the inside surface of the flat iron part and the inside surface of the comb part.

4. The device of claim 3, wherein the device is further configured to allow a user to heat the hair of the user between the inside surface of the flat iron part and the inside surface of the comb part in the closed position by applying heat to the heating plate and the plurality of heating elements.

5. The device of claim 1, wherein the handle of the flat iron part comprises a heat setting control panel.

6. The device of claim 5, wherein the heat setting control panel comprises heat setting controls and a heat display.

7. The device of claim 1, wherein each heating element comprises double-side ceramic material configured to evenly transfer heat.

8. The device of claim 1, wherein the power cord connects to the comb part and the flat iron part at the pivot link.

9. The device of claim 1, wherein the pivot link comprises a hinge mechanism.

10. The device of claim 1, wherein when the device is in the closed position, a first edge of the upper portion of the comb part that includes the plurality of heating elements align with a first edge of the upper portion of the flat iron part.

11. The device of claim 1, wherein when the device is in the closed position, a second edge of the upper portion of the comb part aligns with a second edge of the upper portion of the flat iron part.

12. The device of claim 1, wherein when the device is in the closed position, a first edge of the handle of the comb part aligns with a first edge of the handle of the flat iron part.

13. The device of claim 1, wherein when the device is in the closed position, a second edge of the handle of the comb part aligns with a second edge of the handle of the flat iron part.

14. The device of claim 1, wherein each of the plurality of heating elements of the comb part forms an elongated comb tooth, and an elongated axis of each comb tooth runs substantially parallel to the inside surface of the flat iron part when the device is in the closed position.

15. The device of claim 1, wherein, when the device is in the closed position, gaps between the plurality of heating elements overlie regions of the heating plate of the flat iron part.

16. The device of claim 1, wherein, when the device is in the closed position, end portions of the plurality of heating elements extend beyond the heating plate of the flat iron part.

* * * * *